United States Patent [19]

Doss

[11] 4,292,591

[45] Sep. 29, 1981

[54] IGNITION PERFORMANCE MONITOR FOR PERMANENT INSTALLATION

[76] Inventor: James D. Doss, 905 Tewa Loop, Los Alamos, N. Mex. 87544

[21] Appl. No.: 37,330

[22] Filed: May 9, 1979

[51] Int. Cl.[3] ..... F02P 17/00

[52] U.S. Cl. ..... 324/395

[58] Field of Search ..... 324/395, 390

[56] References Cited

U.S. PATENT DOCUMENTS

| | | | |
|---|---|---|---|
| 1,931,225 | 10/1933 | Heaton | 324/395 |
| 3,261,008 | 7/1966 | Schreter et al. | 324/395 X |
| 3,521,157 | 7/1970 | Robertson | 324/395 |
| 3,693,148 | 9/1972 | Pittman | 324/395 X |
| 3,978,720 | 9/1976 | Ford | 324/395 X |

FOREIGN PATENT DOCUMENTS

| | | | |
|---|---|---|---|
| 188980 | 3/1957 | Austria | 324/395 |
| 536847 | 10/1931 | Fed. Rep. of Germany | 324/395 |
| 946668 | 12/1948 | France | 324/395 |
| 1060978 | 11/1953 | France | 324/395 |
| 1161569 | 3/1958 | France | 324/395 |
| 325567 | 2/1930 | United Kingdom | 324/395 |

*Primary Examiner*—Stanley T. Krawczewicz

[57] ABSTRACT

An electric ignition performance monitoring device for permanent installation as an integral part of the ignition system used in conjunction with internal combustion engines wherein light is emitted from sensors when arc current flows across spark plug gaps. Further means are provided for viewing the light from the sensors at a location which is remote from the location of the components of the ignition system but convenient for the operator of the engine, and means for enabling the operator to rapidly determine which particular portion of the ignition system is malfunctioning.

5 Claims, 5 Drawing Figures

FIG. 2
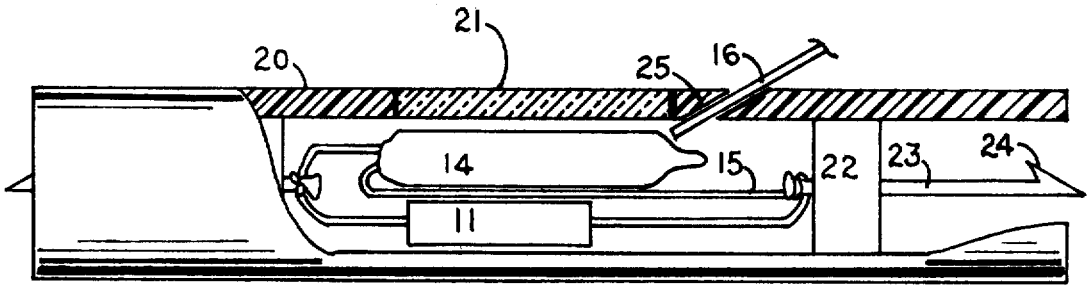
FIG. 3
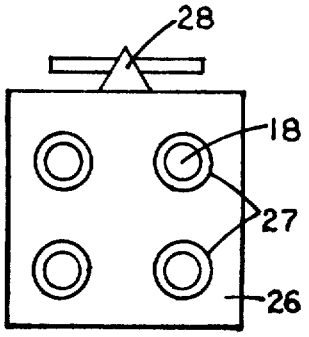
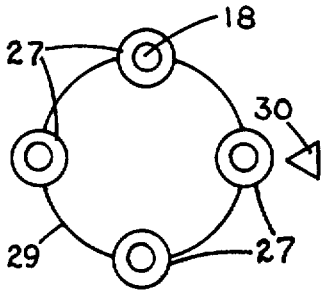
FIG. 4

IGNITION PERFORMANCE MONITOR FOR PERMANENT INSTALLATION

BACKGROUND OF THE INVENTION

In the operation of an internal combustion engine, the operator may have difficulty in starting the engine or in obtaining proper performance once the engine has been started. Such problems are typically due either to fuel system or electrical ignition system malfunctions. The operator must first determine which category of engine problem is most probably the cause of the malfunction, so that repair or adjustment efforts may be concentrated in the proper direction.

Efforts have been made to solve this problem by providing the operator with information relating to the performance of the electrical ignition system. U.S. Pat. No. 2,278,084 issued to T. L. Mayeux and H. A. Levey describes a transparent distributor cap which provides integral sensors for each spark plug cable. A hand-held device utilizing a transformer and glow lamp is described by W. J. Cook in U.S. Pat. No. 3,452,270. Spark plugs with internal light-emitting sensors are described by A. Candelise and J. A. Whaley in U.S. Pat. No. 3,242,366 and by R. W. Smith in U.S. Pat. No. 3,348,087. A voltage monitor is described by M. E. Gerry in U.S. Pat. No. 3,839,671.

In regard to the prior art, it may be seen that a device for measuring voltage at a spark plug high voltage terminal is useful but insufficient for reliable detection of faulty spark plugs. The presence of voltage at the spark plug terminal does not indicate that the spark plug has actually fired. A device which measures spark plug current flow is a more useful indicator of spark plug performance. A general indication of spark plug current is not certain proof of proper spark plug operation however, since current will flow across the conductive carbon deposit on a fouled spark plug insulator. A simple series spark gap or neon glow lamp is not able to distinguish between these normal and abnormal current conditions, since either case causes the spark gap or neon glow lamp to break down and emit light. A current sensing device would be a much more reliable indicator of proper spark plug performance (as well as the rest of the ignition system) if it had the capability to distinguish between normal and abnormal spark plug currents. It will be shown that the present invention meets this important requirement and has other new features which are significant improvements in this field of art.

The present invention provides a composite current sensor which has been designed to be selectively sensitive to the normal spark plug gap current and insensitive to abnormal currents which flow through conductive deposits on fouled spark plug insulators. The design is based upon observations of current waveforms present in spark plug high voltage leads in typical electric ignition systems. In normal ignition system operation, current does not flow through the spark plug until the high voltage source (usually an autotransformer) has charged the parasitic capacitance of the system to levels of several thousand volts. When the spark plug gaps arc, this parasitic capacitance acts as a relatively low impedance source of current. Peak normal spark plug current is an ignition system utilizing high resistance cable or resistor type spark plugs is on the order of 200 milliamperes. By contrast, current flow through a conductive deposit on the spark plug insulator is supplied primarily by the relatively high impedance high voltage source and is therefore lower in peak amplitude than the normal current. Tests indicate that peak abnormal current levels do not exceed about 40 milliamperes even when the spark plug insulators are short circuited to simulate very heavy conductive deposits. This information has been utilized in the design of the composite current sensor which is an important feature of the present invention. The composite current sensor is comprised of two basic elements which are connected electrically in parallel. The light emitting member of the composite current sensor is a two electrode gaseous discharge device, which may be either a neon glow lamp or a spark gap. The second member of the composite current sensor is a resistance element, which is connected in parallel with the gaseous discharge device. The composite current sensor is connected in series with a high voltage conductor, said high voltage conductor being used as a path for current between the ignition system high voltage source (typically an autotransformer) and a spark plug high voltage terminal. The parallel resistance element serves as a means to determine the sensitivity of the composite current sensor and thereby provide the sensor with the characteristic of being capable of distinguishing between normal and abnormal spark plug current. Before the correct value of resistance can be selected, it is necessary to know the breakdown voltage of the gaseous discharge device and the peak values of normal and abnormal spark plug current. For an example, consider the values of normal and abnormal peak current given previously for a typical automotive ignition system, i.e. 200 and 40 milliamperes respectively. If the gaseous discharge device is a typical high brightness neon glow lamp such as the NE-2H lamp, breakdown voltage will be approximately 100 volts. Prior to breakdown of the neon lamp, spark plug current will flow through the parallel resistance element. This resistance value must be smaller than a critical upper limit value which would develop the breakdown potential (100 volts) when the abnormal current was present (40 milliamperes). This condition sets an upper limit on the resistance value of 2500 ohms. In addition, the resistance value must be larger than a critical minimum value which just allows the breakdown potential (100 volts) to be developed in the presence of normal spark plug current (200 milliamperes). This condition sets a lower limit on the resistance value of 500 ohms. In summary, the resistance value is confined to a range between 500 and 2500 ohms so that the composite current sensor may be able to distinguish between the normal and abnormal spark plug currents. In practice, it has proven useful to select a value of resistance in the upper portion of this range, since peak normal spark plug currents are somewhat variable as the spark plug gap fires at slightly different potentials on each occasion. For this reason, values of approximately 2000 ohms have been successfully used in tests of the invention in simulated ignition systems and in actual automobile ignition systems. When dealing with an ignition system which does not use additional resistance (in the form of high resistance cables or resistance spark plugs) both the normal and abnormal spark plug currents are relatively higher, so that the appropriate value of parallel resistance in the composite current sensor will be lower. In practice, values of 100 to 400 ohms have proven to be appropriate in such ignition systems when used in combination with neon glow lamps with 100 volts breakdown potential. The use of spark gaps for the gaseous discharge device will typically require the use of relatively larger values of parallel resistance since breakdown voltages will be higher than 100 volts.

Tests of the present invention in simulated ignition systems as well as in typical automobile ignition systems indicate that the gaseous discharge device will emit sufficient light for viewing in typical daylight ambient light conditions when the ignition system is operating in a proper fashion. The tests show that the sensor will not emit visible light when the high voltage circuit is open, or when spark plug insulators are coated with a conductive carbon deposit. In the latter instance, carbon deposits were simulated by placing various resistors in parallel with the spark plug gap. The resistance value of these simulated carbon deposits ranged from 0.1 to 20,000 ohms and the sensor did not emit light under these conditions.

In addition to being able to distinguish between normal and abnormal currents, the present invention provides means for visual observation of the condition of the electrical ignition system at a location which is remote from the ignition system components. This is a particularly important feature for the operator of an automobile, where the operator must start and operate the engine at a location which is remote from the components of the ignition system. The present invention provides for location of the light emitted from the sensor at a position which is in optical communication with the operator of the engine. Two means are provided for this remote monitoring, which may be used separately or in combination. The first method involves the location of the gaseous discharge device at a position which is remote from the ignition system but within the visual field of the operator. This is done by providing a lengthened electrical conductor between the appropriate points on the ignition system and the terminals of the gaseous discharge device. Tests indicate that this method is quite effective, but electrical insulation around the extended electrical conductors must be able to withstand the high voltage on the ignition system without breakdown to nearby conductive bodies. This requirement leads to a somewhat bulky cable system when several spark plugs must be monitored. The second method involves the use of plastic or glass fiber optical light guides to transmit from the gaseous discharge device to a remote location which is in the field of view of the operator. In a typical instance, the receiving end of the fiber optical light guide would be in optical communication with the gaseous discharge device portion of the composite current sensor. The transmitting end of the fiber optical light guide would be placed in the instrument panel of an automobile or motorcycle for convenient viewing by the operator of the vehicle. In either of these two methods for locating the lights from the composite current sensor at a location remote from the ignition system, the present invention provides for functional enhancement of the use of the remote monitor by arrangement of the individual lights in a pattern which corresponds to the actual physical arrangement of relevant components in the ignition system. Typical patterns used as illustrative examples in the present invention include geometrical arrangements which correspond to the layout of spark plugs on the engine block or to the location of electrical connections on the distributor cap. In either case, a key would be provided which corresponded to some actual physical component on the engine or to a similar abstract symbol placed on the engine. This latter feature would serve the function of orienting the operator or mechanic in relation to the correspondence between the individual lights in the remote pattern and the actual components in the ignition system.

The invention may be provided as an add-on component for an existing ignition system, where the sensor units are added to existing high voltage conductors on the engine. As an alternate method of using the invention, the composite current sensors may be incorporated into the high voltage ignition cables at the time of manufacture of such cables. In the case of a single cylinder engine, such as is commonly used in motorcycles, lawnmowers and outboard motors for boats, only one composite current sensor unit may be installed in the high voltage connection between the ignition system high voltage source and the single spark plug. In the case of internal combustion engines with multiple spark plugs, one composite sensor unit may be in series with the high voltage cable which supplies current to each spark plug. While a discrete resistance element will probably be used as the parallel resistance element in the composite current sensor in the majority of cases, it is possible to utilize a section of high-resistance spark plug cable as a substite distributed resistance element to replace the discrete resistance element. In certain instances, this method may simplify the manufacture and cost of the composite current sensor provided by the present invention.

BRIEF DESCRIPTION OF THE DRAWINGS

FIG. 2 is a drawing of one version of the composite current sensor which may be installed in series with a spark plug high voltage cable.

FIG. 3 illustrates a geometrical arrangement of remotely located composite current sensor lights which correspond to spark plug locations on an engine block.

FIG. 4 illustrates a geometric arrangement of remotely located composite current sensor lights which correspond to spark plug wiring locations on a distributor cap.

DESCRIPTION OF THE PREFERRED EMBODIMENT

Figure 1:
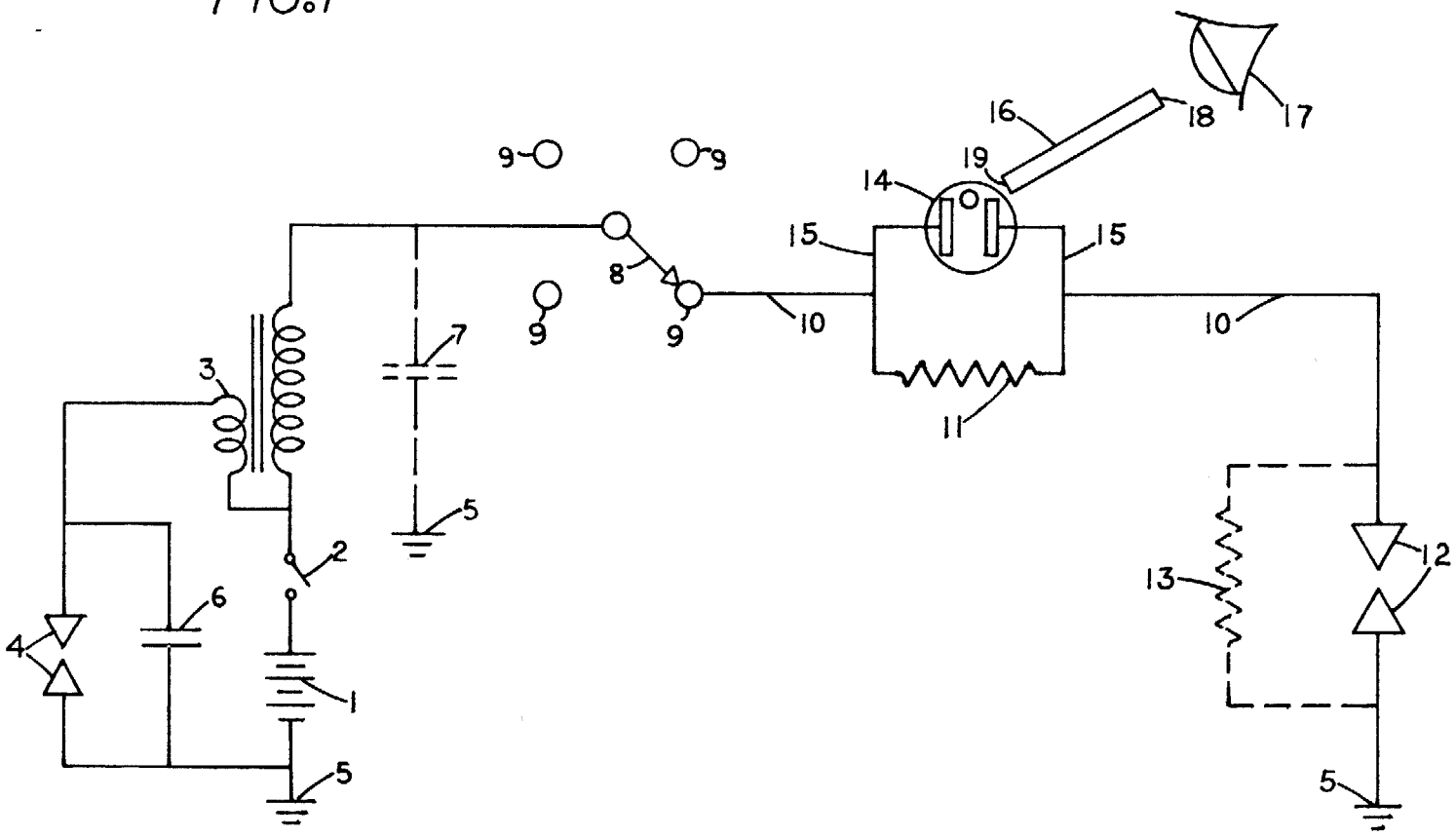
FIG. 1 is a schematic drawing of a typical electrical ignition circuit which has essential elements of the invention added for the purpose of illustrating the principles of operation of the invention.

Referring now to FIG. 1, a schematic diagram illustrates the preferred mode of operation of the present invention. A standard type of ignition system using breaker points 4 and autotransformer 3 is used to illustrate the operation of the composite current sensor which is comprised of gaseous discharge device 14 and parallel resistance element 11, but the invention could be adapted readily to any other type of ignition system which produces high voltage impulses for one or more spark plugs. In the circuit shown in FIG. 1, current is supplied to the autotransformer 3 primary winding through ignition switch 2 from battery 1 whenever breaker points 4 are closed. When current is flowing as described and breaker points 4 are then opened, a rapid change in the intensity of the magnetic flux in the core of autotransformer 3 causes current to flow through capacitor 6 and a voltage (on the order of 400 to 600 volts) to appear across the primary winding of autotransformer 3. Voltage across the secondary winding of autotransformer 3 will begin rising towards a much higher level (on the order of 16,000 to 24,000 volts) and parasitic system capacitance 7 will be charged by this increasing voltage which will also be applied to distributor rotor 8 and one of the distributor output terminals 9. This same voltage will be applied to spark plug gap 12 through the electrical connection made by spark plug high voltage cable 10 and elements of the composite current sensor, namely discrete resistance element 11 and gaseous discharge device 14, should this latter device ionize. Parasitic resistance element 13 illustrates the effect of conductive carbon deposits which are a common cause of spark plug failure. A ground connection 5 is made to terminals on the battery 1 and spark plug gap 12 so that the circuit current path may be complete. The receiving face 19 of fiber optical light guide 16 is in close optical communication with gaseous discharge device 14. The transmitting face 18 of fiber optical light guide 16 is in optical communication with the eye 17 of an observer at a location remote from the ignition system. Electrical conductors 15 attached to gaseous discharge device 14 may be lengthened so that gaseous discharge device 14 may be located directly at a location remote from the components of the ignition system.

While, for the purpose of simplicity and clarity, only one composite current sensor comprising discrete resistance element 11 and gaseous discharge device 14 are shown in FIG. 1, similar devices would generally be connected in series with additional spark plug high voltage cables 10 which in turn would be utilized to provide a path for current from various distributor output terminals 9 and associated spark plug gaps 12.

Referring now to FIG. 2, one method is presented for incorporating the composite current sensor into series connection with a spark plug high voltage cable 10, as shown schematically in FIG. 1. Composite current sensor comprised of gaseous discharge device 14 (a glow lamp in this illustrative example) and discrete resistance element 11 are connected electrically in parallel. Each end of the resultant composite current sensor is then electrically connected to a conductive element 23 which is provided with a barb 24 at the pointed end opposite from end with said electrical connection. Conductive elements 23 are supported by cylindrical members 22 which in turn fit tightly inside hollow cylindrical plastic member 20. Hollow cylindrical plastic member 20 is provided with transparent section 21 adjacent to gaseous discharge device 14. Hollow cylindrical plastic member 20 is additionally provided with entry port 25 so that fiber optical light guide 16 may be inserted adjacent to gaseous discharge device 14.

The composite current sensing device shown in FIG. 2 is used in the following manner. A section of spark plug high voltage cable 10 is selected which is convenient for local viewing. Said cable 10 is then cut through at a convenient location and each cut end is then pressed into an end of hollow cylindrical member 20 so that the pointed ends of conductive elements 23 make electrical and mechanical connection with the center axis of said spark plug high voltage cable 10. Barb 24 on conductive member 23 serves to mechanically anchor this connection. Care must be taken to orient transparent section 21 so that light from gaseous discharge device 14 will be visible to a local observer. Fiber optic light guide 16 may be inserted through entry port 25 so that light from gaseous discharge device 14 may be transmitted to a location remote from the ignition system and emitted from face 18 which is shown in FIG. 1.

Referring now to FIG. 3 and FIG. 4, geometric means are illustrated which have the functional purpose of enabling the observer of the transmitting face 18 of individual fiber optic light guides 16 (as shown in FIG. 1 and FIG. 2) to rapidly identify the section of the ignition system which corresponds to a particular transmitting face 18. Each transmitting face 18 is placed in a port 27 whose location corresponds to a spark plug location as in the representative engine block 26 in FIG. 3 or to a spark plug wire location as is illustrated on the representative distributor cap 29 in FIG. 4. To facilitate rapid orientation of the observer, keys are provided in each case. The example shown in FIG. 3 is an instance where the observer is referred to an actual part of the engine, a fan 28 in this case. The observer may also be referred to an abstract symbol which has been placed on the remotely viewed geometric arrangements of light transmitting faces 18 as well as added to a corresponding location on the engine. An example of the abstract symbol is illustrated by example in FIG. 4 where a triangle 30 has been placed adjacent to a port 27 and would also be placed adjacent to the appropriate distributor electrical connection on the engine.

Figure 5:
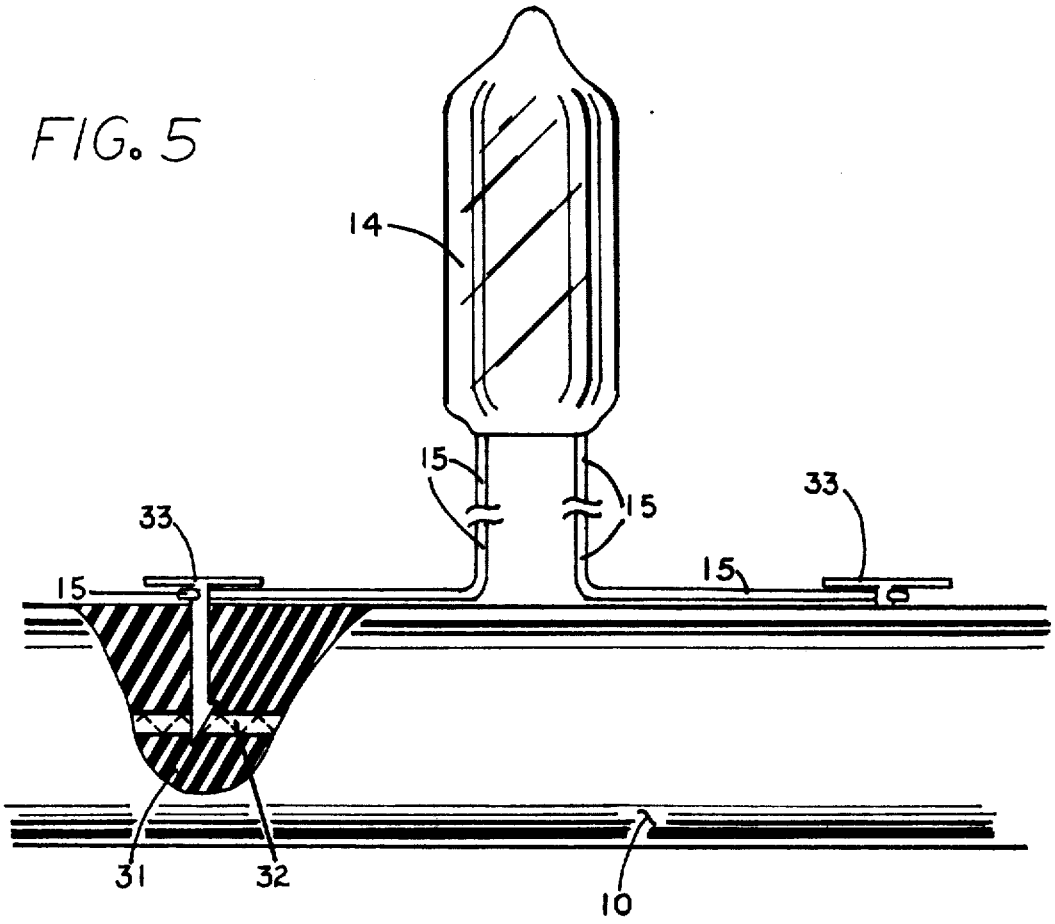
FIG. 5 illustrates one method by which a segment of high resistance spark plug cable may substitute for the discrete parallel resistance element shown in FIG. 1 and FIG. 2.

FIG. 1 and FIG. 2 illustrate very general embodiments of the invention which may be added to any ignition system which is used with internal combustion engines. FIG. 5 illustrates an embodiment of the present invention which is only applicable in ignition systems which may use high resistance ignition cables. In this embodiment of the invention, distributed resistance in a segment of existing or added high resistance cable is substituted for the discrete parallel resistance element 11 illustrated in FIG. 1 and FIG. 2.

Referring now to FIG. 5, gaseous discharge device 14 is connected to conductive elements 33 through conductive leads 15 whose length may be adjusted to be long enough for remote viewing or short enough for local viewing of gaseous discharge device 14. Conductive elements 33 are inserted into high resistance spark plug cable 10, penetrating rubber section 31 and making electrical contact with high resistance conductive section 32 at locations which are separated along the central axis of cable 10. It is clear that appropriate insulation and mechanical mounting arrangements would be required in most cases around gaseous discharge device 14, conductive leads 15 and conductive elements 33 but these additional elements have not been shown if FIG. 5 for the sake of simplicity and clarity.

Referring now to FIG. 1, FIG. 3 and FIG. 4, it should be clear that the functional geometric arrangements which are illustrated in FIG. 3 and FIG. 4 could also be achieved by direct placement of gaseous discharge devices 14 in remote viewing ports 27 and that the placement of fiber optic light guide 16 transmitting faces 18 in said remote viewing ports 27 does not limit the present invention to this latter method for remote viewing of the condition of the ignition system.

Referring again to FIG. 2, it is to be clearly understood that the present invention is not limited to this particular method of inserting the composite current sensor in series with a spark plug high voltage cable 10, as shown more generally in FIG. 1.

A variety of techniques and methods for utilizing and manufacturing the present invention are likely to occur to those familiar with this field of art, but it is to be clearly understood that the present invention is not limited to the specific features set forth herein above but may be carried out in other ways without departing from its spirit.

What I claim is:

1. A device which may be permanently installed for visually monitoring the performance of electrical ignition systems which are used in the operation of internal combustion engines, wherein parasitic system capacitance is that electrical capacitance which exists between the ignition system high voltage terminal and the ignition system ground connection to the engine, comprising:

a composite current sensor which is a combination of two components connected electrically in parallel; the first component being an electrical resistance element and the second component being a gaseous discharge device consisting essentially of two electrically conductive electrodes which are separated within a region containing a gas or mixture of gases which will ionize and emit visible light when electric current flow resulting from a discharge of parasitic system capacitance through said parallel resistance element causes a sufficient electric potential to be developed between the said two electrodes to cause ionization of said gaseous discharge device, and electrical connection of said composite current sensor comprising said resistance element and said gaseous discharge device in series with an electrical conductor which is used to provide a path for electrical current flow between a source of high voltage and a spark plug high voltage terminal wherein said spark plug is used in an electric ignition system which is incorporated into an internal combustion engine.

2. The invention as recited in claim 1, wherein said gaseous discharge device is a neon glow lamp.

3. The invention as recited in claim 1, wherein light from individual composite current sensors is conveyed to a location remote from the ignition system by means of fiber optical light guides, wherein multiple such fiber optical light guides are geometrically arranged at the remote location so that the pattern of individual light emissions from the fibers corresponds to the geometric pattern of related components in the ignition system such as spark plugs or distributor terminals.

4. The invention as recited in claim 1, wherein said electrical resistance element utilized in said composite current sensor is a length of high resistance suppressor type spark plug cable.

5. The invention as recited in claim 1, wherein gas utilized in said gaseous discharge device is ordinary atmospheric gas, this being accomplished by exposing electrodes in gaseous discharge device to the local atmosphere.

* * * * *